US007191967B2

(12) United States Patent
Vuorio et al.

(10) Patent No.: US 7,191,967 B2
(45) Date of Patent: Mar. 20, 2007

(54) REFINER

(75) Inventors: Petteri Vuorio, Valkeakoski (FI); Matti Kaarineva, Lempäälä (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/560,660

(22) PCT Filed: Jun. 10, 2004

(86) PCT No.: PCT/FI2004/000360

§ 371 (c)(1),
(2), (4) Date: Dec. 13, 2005

(87) PCT Pub. No.: WO2004/110628

PCT Pub. Date: Dec. 23, 2004

(65) Prior Publication Data

US 2006/0151648 A1 Jul. 13, 2006

(30) Foreign Application Priority Data

Jun. 18, 2003 (FI) ..... 20030917

(51) Int. Cl.
*B02C 7/04* (2006.01)

(52) U.S. Cl. ..... 241/261.3; 241/296

(58) Field of Classification Search ..... 241/261.2, 241/261.3, 296, 297, 298
See application file for complete search history.

(56) References Cited

U.S. PATENT DOCUMENTS 1,114,339 A 10/1914 Bryant
3,674,217 A 7/1972 Reinhall
4,772,358 A 9/1988 Virving
5,112,443 A * 5/1992 Virving et al. ..... 162/23
5,439,183 A 8/1995 Virving
5,683,048 A 11/1997 Virving
6,311,907 B1 11/2001 Gingras
6,607,153 B1 8/2003 Gingras

FOREIGN PATENT DOCUMENTS

GB 1 306 775 2/1973
WO WO 99/54046 10/1999

OTHER PUBLICATIONS

International Search Report for PCT/FI2004/000360 completed Oct. 18, 2004.
Written Opinion of the International Searching Authority form PCT/FI2004/000360 mailed Oct. 20, 2004.
Office Action issued in Finnish Priority Appl. No. 20030917 dated Feb. 3, 2004.

* cited by examiner

*Primary Examiner*—Faye Francis
(74) *Attorney, Agent, or Firm*—Alston & Bird LLP

(57) ABSTRACT

A refining surface for a refiner intended for defibrating lignocellulose-containing materials, the refiner having at least two refining surfaces arranged coaxially relative to each other, at least one of which rotates around a shaft, and between which the material to be defibrated is fed. The refining surfaces define grooves and between them ridges, at least part of the refining surface ridges being formed of at least two different ridge parts connected to each other in such a way that one ridge part is farther ahead in the rotation direction of the refining surface than the other ridge part. Further, at least in some ridge parts, the front wall in the rotation direction of the refining surface is over at least part of its length substantially inclined.

9 Claims, 4 Drawing Sheets

REFINER

FIELD OF THE INVENTION

The invention relates to a refining surface for a refiner intended for defibrating lignocellulose-containing material, the refiner comprising at least two refining surfaces arranged coaxially relative to each other, at least one of which rotates around a shaft, and between which the material to be defibrated is fed, and which refining surfaces comprise grooves and between them ridges, at least part of the refining surface ridges being formed of at least two different ridge parts connected to each other in such a way that one ridge part is farther ahead in the rotation direction of the refining surface than the other ridge part.

BACKGROUND OF THE INVENTION

Disc and cone refiners used for manufacturing mechanical pulp are formed of two refiner discs opposite to each other which turn relative to each other and one or both of which is/are rotating. In disc refiners the refiner disc is disc-like and in cone refiners it is conical. The refining surfaces of refiner discs are typically formed of grooves and of protrusions between them, i.e. blade ridges, which will be hereafter called ridges. The shape of these grooves and ridges per se may vary in different ways. Thus, for example, in the radial direction of the refiner disc the refining surface may be divided into two or more circular parts, each of which may comprise grooves and ridges of different shapes. In the same way, the number and density of ridges and grooves as well as their shape and direction in each circle may deviate from each other. Thus, the ridges may be either continuous over the whole length of the refining surface radius or there may be a plurality of successive ridges in the radial direction. A plurality of refiner segments consisting of structures formed of ridges and grooves between them are arranged upon the discs. One of the refiner discs comprises an opening through which the material to be refined is fed into the refiner. The refiner discs are positioned in such a way that the refiner segments form a refiner gap, through which the fibre material is intended to be discharged from the inside, where the ridges of the refiner elements carry out the disintegration. The distance between the refiner discs is longest in the middle of the discs, being reduced towards the outer periphery in order to refine the material gradually.

U.S. Pat. No. 6,311,907 discloses a refiner disc on the refining surface of which some of the ridges in the radial direction of the refiner disc are formed of ridge parts connected to each other in the radial direction of the refiner disc in such a way that between the ridge parts of the refiner disc at their connection point, there is a connecting part that is directed obliquely relative to the direction of the refiner disc radius, which part connects the ridge parts forming the ridge to each other in such a way that the ridge travels windingly from the direction of the inner periphery of the refiner disc to the direction of its outer periphery. The intention of a winding ridge structure is to make the refining more efficient by preventing the material to be refined from moving too rapidly out of the space between the refiner discs towards the outer periphery of the disc. In one embodiment of the publication, the connecting part connecting the ridge parts together is designed to form an adjacent ramp inclined in the direction of the connecting part between the ridge parts, the purpose of the ramp being to facilitate the movement of the material to be refined out of the grooves between the ridge parts of the refining surface to the space between the refiner discs.

It has also been noted that when fibre material is disintegrated to achieve a better final product, it is advantageous to position flow restrictors, i.e. what are called dams, across the grooves of the refiner segments so as to prevent untreated material from getting through the refiner gap. The fibre pulp is forced up from the grooves by the dams and is guided to the treatment between the blade ridges of the refiner segments upon the opposite refiner discs. The more dams there are in the refiner segment, the higher the quality of the fibre pulp obtained from the refining. In practice, however, the number of dams must be kept restricted, because the more dams there are in the refiner segment, the more difficult it is for the water in the refiner gap and the vapour generated due to the high power directed at the disc refiner during the refining to discharge from the refiner gap, and thus the production capacity of the refiner is reduced. In addition, the vapour pressure generates great axial forces between the refiner segments, particularly in the outer part of their periphery, which loads the refiner bearings and thus also restricts the runnability of the refiner. High vapour pressure also causes bending of refiner segments so that the segments loose their parallelism.

BRIEF DESCRIPTION OF THE INVENTION

An object of the present invention is to provide a refining surface of a new type for a refiner intended for defibrating lignocellulose-containing material.

The refining surface according to the invention is characterized in that at least in some ridge parts in the rotation direction of the refining surface, the front wall is over at least part of its length substantially inclined.

According to an essential idea of the invention, on the refining surface for such a refiner intended for defibrating lignocellulose-containing material that has at least two refining surfaces arranged coaxially relative to each other, at least one of which rotates around a shaft and between which the material to be defibrated is fed and which refining surfaces have grooves and between them ridges and at least part of the refining surface ridges are formed of at least two different ridge parts connected to each other such that one of the ridge parts is farther ahead in the rotation direction of the refining surface than the other ridge part, the wall on the side of the rotation direction of the refining surface is at least in some ridge parts over at least part of its length substantially inclined.

Preferred embodiments of the invention are described in the dependent claims.

An advantage of the invention is that it causes the material to be refined to move more efficiently out of the grooves of the refining surface to the space between opposite refining surfaces, providing thus higher quality for the refined final product and keeping the production capacity of the refiner high.

BRIEF DESCRIPTION OF THE FIGURES

The invention will be described in greater detail in the attached figures, of which

For the sake of clarity, the invention is shown simplified in the figures. Similar parts are denoted with the same reference numerals.

DETAILED DESCRIPTION OF THE INVENTION

Figure 1:
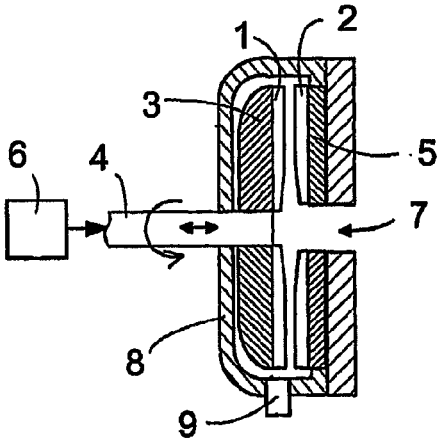
FIG.1 PRIOR ART
FIG. 1 shows schematically a cross-section of a conventional disc refiner.

FIG. 1 shows schematically a side view and cross-section of a conventional disc refiner. The disc refiner comprises two disc-like refining surfaces 1 and 2, which are positioned coaxially relative to each other. In this embodiment, one refining surface 1 is in a rotating refiner disc 3, which is rotated by means of a shaft 4. The other refining surface 2 is in this case in a fixed refiner disc 5, i.e. in a stator. The refining surfaces 1 and 2 in the refiner discs 3 and 5 may be either formed directly to the discs or formed of separate refiner segments in a manner known per se. Further, FIG. 1 shows a loader 6 connected to affect the refiner disc 3 via the shaft 4 in such a way that it can be pushed towards the refiner disc 5 to adjust the opening between them. The refiner disc 3 is rotated via the shaft 4 in a manner known per se by means of a motor not shown for the sake of clarity.

The lignocellulose-containing material to be defibrated is fed through an opening 7 in the middle of the other refining surface 2 to the opening between the refining surfaces 1 and 2, i.e. the refiner gap, where it is defibrated and ground at the same time as the water in the material vaporizes. The lignocellulose-containing material to be defibrated can be fed into the refiner gap also through openings on the refining surface 2, which are not shown in the figure for the sake of clarity. The lignocellulose-containing material that has been defibrated is discharged from the space between the refiner discs through an opening between the discs, i.e. from the outer edge of the refiner gap, into the inside of a refiner chamber 8, from where it is further discharged along a discharge channel 9.

Figure 2:
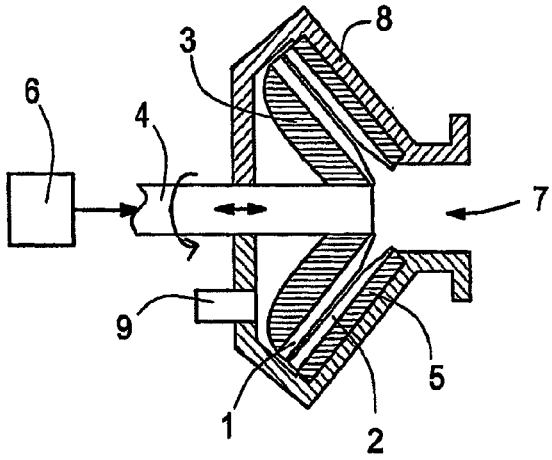
FIG. 2 PRIOR ART
FIG. 2 shows schematically a cross-section of a conventional cone refiner.

FIG. 2 shows schematically a side view and cross-section of a conventional cone refiner. The cone refiner comprises two conical refining surfaces 1 and 2, which are positioned within each other coaxially. In this embodiment, one refining surface 1 is in a rotating conical refiner disc 3, which is rotated by means of the shaft 4. The other refining surface 2 is in this case in a fixed conical refiner disc 5, i.e. in a stator. The refining surfaces 1 and 2 of the refiner discs 3 and 5 may be either formed directly to the discs or formed of separate refiner segments in a manner known per se. Further, FIG. 2 shows a loader 6 connected to affect the refiner disc 3 via the shaft 4 in such a way that it can be pushed towards the refiner disc 5 to adjust the opening between them. The refiner disc 3 is rotated via the shaft 4 in a manner known per se by means of a motor not shown for the sake of clarity.

The lignocellulose-containing material to be defibrated is fed through an opening 7 in the middle of the refining surface 2 into a conical gap between the refining surfaces 1 and 2, i.e. conical refiner gap, where it is defibrated and ground. The lignocellulose-containing material that has been defibrated is discharged from the space between the refiner discs through an opening between the discs, i.e. from the outer edge of the refiner gap, into the inside of the refiner chamber 8, from where it is further discharged along the discharge channel 9.

Figure 3:
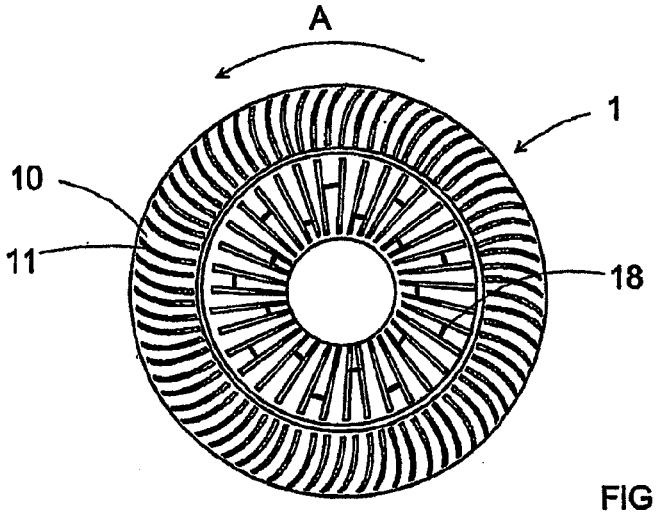
FIG. 3 PRIOR ART
FIG. 3 shows schematically a typical refiner disc, seen from the refining surface.

FIG. 3 shows schematically a typical refining surface of a disc refiner, seen from the axial direction. The refining surface comprises in the peripheral direction of the refiner alternately grooves 10 and ridges 11 at the same point. The refining surface also comprises flow restrictors, i.e. what are called dams 18, arranged across the grooves 10, with which untreated material is prevented from getting out of the refiner gap. The dams 18 force the fibre pulp out of the grooves 10 but make it more difficult for the water and the vapour generated due to the high power directed at the refiner during the refining to discharge from the refiner gap. By way of example, the refining surface has been here divided in the radial direction into two successive circles with grooves and ridges of different shapes compared with each other. Hence, by way of example, the ridges in the outer circle may be curved over at least part of their length, as shown in FIG. 3, relative to the rotation direction indicated by arrow A, in such a way that the intermediate material on the outer periphery of the refining surface is "pumped" from the refiner outwards. There are, in a manner known per se, several different refining surfaces formed either directly to the refiner disc or of different surface elements.

Figure 4:
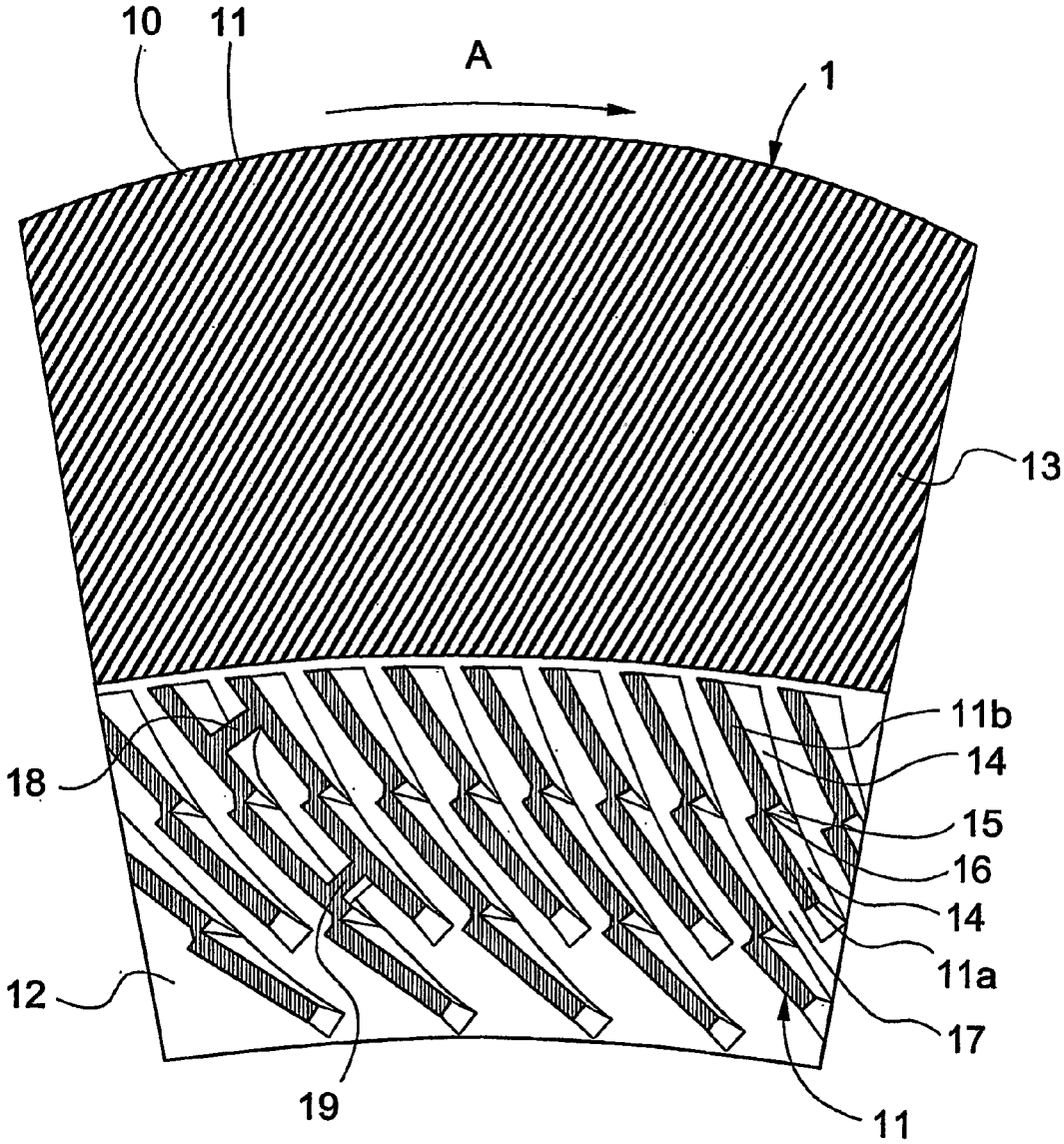
FIG. 4 shows schematically a refiner segment according to the invention.

FIG. 4 shows schematically a part, i.e. segment, of the refining surface 1 according to one solution, where the refining surface 1 is, by way of example, divided into two circles 12 and 13 that are successive in the radial direction. The ridges 11 of the inner circle 12 are shaped in such a way that they are formed of at least two different ridge parts 11*a* and 11*b*. The ridge parts 11*a* and 11*b* are connected to each other in such a way that the ridge part 11*a* closer to the central shaft 4, i.e. the rotation shaft of the refining surface 1, is at the connecting point of the ridge parts 11*a* and 11*b* farther behind relative to the central shaft 4 in the rotation direction indicated by arrow A than the ridge part 11*b* farther off from the central shaft 4. The ridge parts 11*a* and 11*b* may also be connected to each other in such a way that the ridge part 11*a* closer to the central shaft is at the connecting point of the ridge parts 11*a* and 11*b* farther ahead relative to the central shaft 4 in the rotation direction than the ridge part 11*b* farther off from the central shaft 4. The ridge parts 11*a* and 11*b* may also have the direction of the radius of the refining surface 1, or they may curve forwards relative to the rotation direction of the refining surface. The outer circle 13 is shaped in such a way that the grooves 10 and ridges 11 in it are radial, or they may be directly or curvingly −45 to +45 degrees in relation to the radius of the refining surface 1. The segments of the refining surface 1, i.e. the refiner segments, may also be formed of only one circle similar to the inner circle 12. They may also be formed of several circles similar to the inner circle 12 and outer circle 13. The flow of vapour generated due to the high power directed at the refiner during the refining and the flow of water present in the refiner gap in the grooves 10 need not necessarily be prevented with dams.

Figure 5A:
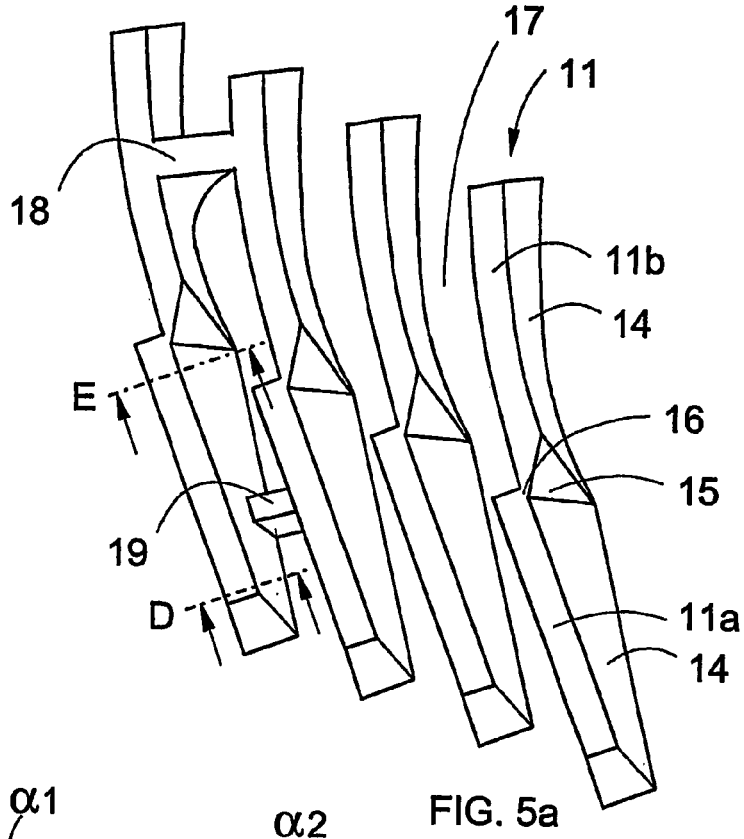
FIGS. 5*a,* 5*b,* 5*c,* 6 and 7 show schematically ridges and grooves according to the invention, located on the refining surface.
Figure 5B:
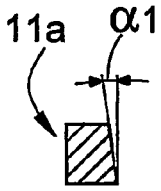
Figure 5C:
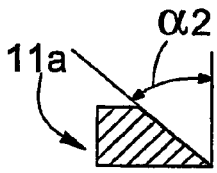

FIGS. 5*a,* 5*b* and 5*c* show schematically some potential embodiments of the ridges 11 on the refining surface according to the solution. FIG. 5*a* shows ridges 11 seen from the direction perpendicular to the refining surface 1, FIG. 5*b* shows a cross-section of the ridge part 11*a* at the section point D, and FIG. 5*c* shows a cross-section of the ridge part 11*a* at the section point E. The lingocellulose-containing material is guided for refining into the refiner gap with the aid of the centrifugal force caused by the rotation of the refiner discs and surfaces via the wall 14 of the side profile of the ridge part 11*a* farther ahead in the rotation direction of the refining surface 1 and an oblique bevel 15 between the ridge parts at the connecting point of the ridge parts 11*a* and 11*b*. The vapour generated due to the high power directed at the refiner during the refining and the water are discharged out of the refiner along the bottom of a groove 17, because they have a lower density than the lignocellulose-containing material, and thus the centrifugal force affecting them is lower than the centrifugal force affecting the lignocellulose-containing material. Therefore, they are guided in the direction where there is open space for flows directed away from the central shaft 4, i.e. the rotation shaft of the refining surface. Designing and dimensioning the shape of the walls 14 and bevels 15 of the ridges as well as their position in the longitudinal direction of the ridges 11, i.e. in the radial direction of the refining surface 1, provides a situation where the lignocellulose-containing material is guided to a refining zone between the refining surfaces 1 and 2, and the vapour and water are discharged out of the refiner along the bottom of the groove 17.

The wall 14 of the ridge parts 11*a* and 11*b* is shaped oblique or inclined backwards relative to the rotation direction A of the refining surface 1 in such a way that angles $\alpha 1$ and $\alpha 2$, shown in FIGS. 5*b* and 5*c*, are formed between the plane normal of the refining surface 1 and the inclined wall 14. Angle $\alpha 1$ indicates the inclination of the ridge part closer to the rotation shaft of the refining surface 1, and angle $\alpha 2$ indicates the inclination of the ridge part farther off from the rotation shaft of the refining surface 1. The inclination of the wall may remain the same over the whole longitudinal direction of the ridge part 11*a* and 11*b*, whereby the angles $\alpha 1$ and $\alpha 2$ are equal over the whole length of the ridge part, but preferably the inclination of the wall of the ridge part increases when moving forwards along the ridge parts 11*a* and 1*b* towards the outer periphery of the refining surface 1; in other words, $\alpha 2$ is thus greater than $\alpha 1$. The magnitude of angle $\alpha 2$ closer to the outer periphery of the refining surface 1 may vary between 15 to 60 degrees, preferably between 30 to 50 degrees, whereas the magnitude of angle $\alpha 1$ closer to the rotation shaft of the refining surface 1 may vary between, for instance, 0.5 to 5 degrees, but preferably angle $\alpha 1$ is at least 10 degrees smaller than angle $\alpha 2$. The magnitude of the angle has the effect that the greater the angle, the more efficiently the material to be refined is guided between the refining surfaces. Thus, when the wall of the ridge part of the refining surface having a great angle of inclination encounters the corresponding wall of the ridge part of the opposite refining surface, the pressure pulse generated between the walls is low, which facilitates the lifting of fibres to the refining, making thus the refining more efficient and improving the pulp quality. Since the inclination of the ridge part wall of the refining surface increases when moving in the direction of the outer edge of the refining surface, the refining effect directed at the material to be refined can be made more efficient when the material to be refined moves between the refining surfaces from the centre of the refining surface in the direction of the outer edge before the material to be refined moves out of the space between the refining surfaces. The farther on in the direction of the outer periphery one moves, the more the refining area increases, and therefore also, it is particularly advantageous for the material to be refined to be guided more efficiently than before out of the grooves to the space between the refining surfaces when moving in the direction of the outer periphery.

The figures show that the wall of the ridge part 11*a* and 11*b* in the rotation direction A of the refining surface 1 is oblique or inclined over the whole length of the ridge part, but it may also be the case that the wall is oblique or inclined only over part of the ridge part length.

When the wall 14 of the ridge parts 11*a* and 11*b* in the rotation direction A of the refining surface 1 is made oblique or inclined over at least part of the length of the ridge part 11*a* and 11*b*, the material to be refined moves more efficiently out of the grooves 17 between the ridges 11 to the upper surface of the ridges 11 between opposite refining surfaces. Thus, the quality of the refined final product can be improved and the production capacity of the refiner can be kept high. Further, the movement of the material to be refined to the space between the refining surfaces 1 and 2 may be made more efficient with an oblique bevel 15 formed at the connecting point of the ridge parts 11*a* and 11*b*, which bevel is designed to rise from the direction of the ridge part 11*a* closer to the rotation shaft of the refining surface 1 towards the ridge part 11*b* farther off from the rotation shaft of the refining surface 1, and which bevel 15 preferably extends as far as to the upper surface of the ridge part 11*b*. These oblique bevels 15 can be formed at all connecting points of the ridge parts 11*a* and 11*b* of the refining surface 1, or at only some of them.

Figure 6:
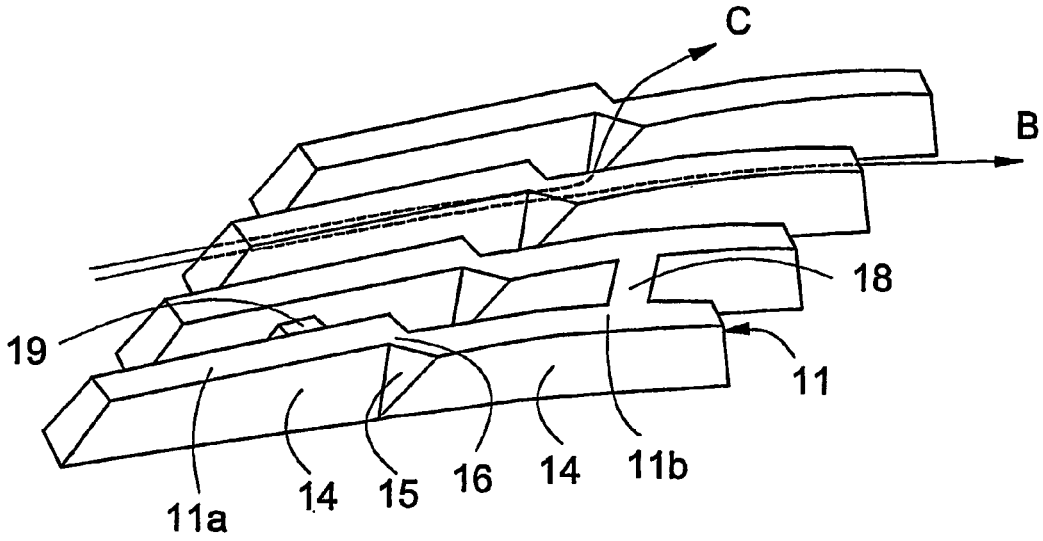

FIG. 6 shows schematically an oblique top view of the ridges 11 on the refining surface 1, seen from the direction opposite to the rotation direction A of the refining surface 1. Further, FIG. 6 indicates with arrow B the flow of vapour and water in the groove 17 between the ridges 11, and with arrow C the movement of the lignocellulose-containing material to the refining zone between the refining surfaces 1 and 2 by means of an oblique bevel 15 at the connecting point of the ridge parts 11*a* and 11*b*. FIG. 6, in the same way as FIG. 5, also shows between adjacent ridge parts in the rotation direction of the refining surface 1 dam-like structures 18 and 19 connecting the ridge parts together, which structures guarantee that the lignocellulose-containing material rises from the groove 17 into the refiner gap between the refining surfaces to be treated. The structures 18 and 19 may extend to the upper edge of the ridge part or to only part of its height.

Figure 7:
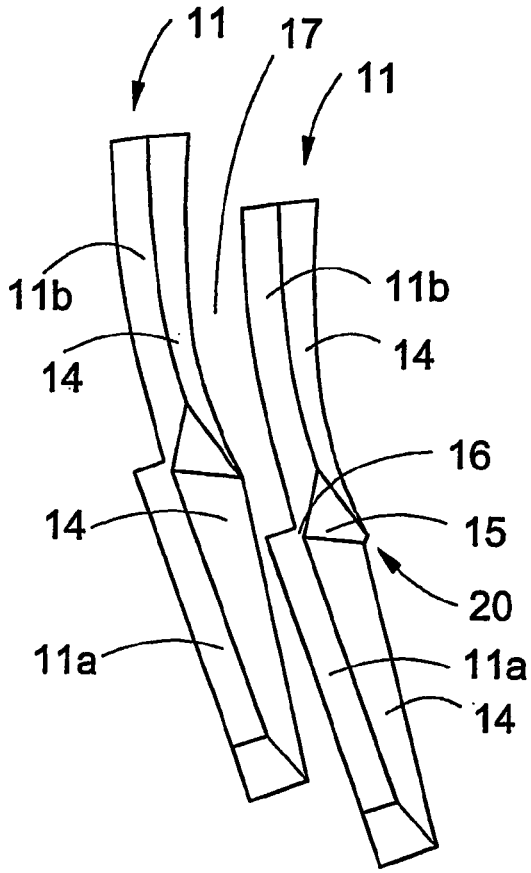
Figure 8:
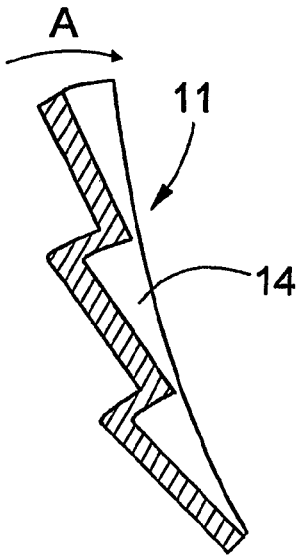
FIGS. 8, 9 and 10 show schematically ridges on the refining surface according to the invention.
Figure 9:
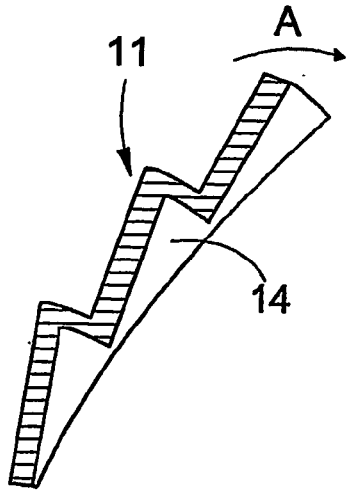
Figure 10:
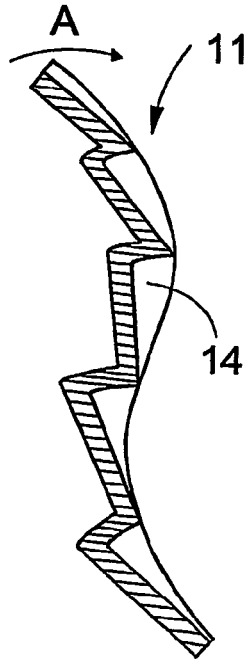

FIG. 5*a* shows that the front wall of the ridge 11 in the rotation direction A of the refining surface 1 in the plane of the groove 17 of the refining surface 1 is continuous, in other words the wall of the ridge part 11*b* continues uninterruptedly with the wall of the ridge part 11*a* without staggering in the plane of the refining surface 1 when one moves in the radial direction of the refining surface 1 from the direction of the inner periphery of the refining surface 1 towards the outer periphery of the refining surface 1. FIG. 7 further shows an embodiment of the ridge 11 where said wall of the ridge 11 on the right-hand side of the figure is not continuous in the plane of the groove 17 of the refining surface 1, but there is in the rotation direction of the refining surface 1, 2 between the front edges of the walls of the ridge parts 11*a* and 11*b* small staggering or a small step 20 in the plane of the groove 17 at the connecting point of the ridge parts 11*a* and 11*b*. The step may even be so big that it begins at the section of the side of the outlet edge of the ridge part located farther on and the bottom plane of the ridge part, in which case the step forms at the same time a dam. Depending on the angle of the step point, however, the dam does not necessarily prevent the flow in the groove essentially, but it guides material to be refined effectively to the space between the refining surfaces. FIGS. 8, 9 and 10 further show schematically and by way of example some feasible shapes of the ridges 11 of the refining surface 1 according to the solution. The ridges 11 of FIGS. 8, 9 and 10 are characterized in that the lower or front edge of the ridge parts follows a continuous line, in other words the ridge parts of the ridge 11 extending from the bottom of the refining surface follow a continuous line, which may turn in several different ways. If there is a step at the connecting point of the different ridge parts of the ridge 11, there must also be at the point of the step a greater angle between the normal of the refining surface and the inclined wall of the ridge part than at the start of the next ridge part.

The drawings and the related description are only intended to illustrate the idea of the invention. The details of the invention may vary within the scope of the claims. Thus, the structural solutions of the segments of the refining discs may vary per se, whereby either one or both of the refining surfaces may be surfaces according to the invention. The refining surfaces are typically vertical and rotate around a central shaft, but it is also feasible to apply the invention to solutions where the refining surfaces are horizontal. The refining surfaces may also be cylindrical or conical. Further, the invention may be applied to low-consistency refining and refining of fibreboard fibres. The refining surface according to the solution may naturally be used also in such refiners where between two refiner discs arranged fixedly, i.e. two stators, there is one rotating refiner disc, on both sides of which there is a refining surface, or in refiners where both refining discs are rotating. In the examples of the figures, the rotation direction A of the refining surface is indicated to be from left to right, but it may naturally be from right to left as well, in which case the shape of the ridges 1 naturally changes in such a way that the inclined wall 14 of the ridges 11 is towards the rotation direction, i.e. at the left edge of the ridges 11 as compared with the figures.

The invention claimed is:

1. A refining surface for a refiner intended for defibrating lignocellulose-containing material, the refiner comprising at least two refining surfaces arranged coaxially relative to each other, at least one of which rotates around a central shaft in a rotation direction, and between which the material to be defibrated is fed, and wherein at least one of the refining surfaces comprises grooves and between them ridges, at least part of the refining surface ridges being formed of at least two different ridge parts each defining a length connected to each other in such a way that one ridge part is farther ahead in the rotation direction of the refining surface than the other ridge part and that at least some ridge parts define a wall relative to the rotation direction of the refining surface which defines an inclination relative to the shaft over at least part of its length, wherein the inclination of the wall of the ridge part changes along at least part of the length of the ridge part in such a way that the inclination of the wall closer to the central shaft of the refining surface is smaller than the inclination of the wall farther off from the central shaft of the refining surface.

2. A refining surface according to claim 1, wherein the inclination of the wall of the ridge part is between 0.5 and 60 degrees.

3. A refining surface according to claim 1, wherein the ridge part closer to the central shaft of the refining surface is, at the a connecting point of the ridge parts in the rotation direction of the refining surface farther behind than the ridge part farther off from the central shaft.

4. A refining surface according to claim 1, wherein the ridge part farther off from the central shaft of the refining surface is, at the connecting point of the ridge parts, in the rotation direction of the refining surface farther behind than the ridge part closer to the central shaft.

5. A refining surface according to claim 1, wherein the two successive ridge parts define front edges that are continuous when seen from the rotation direction of the refining surface.

6. A refining surface according to claim 1, wherein the two successive ridge parts define front edges that are staggered relative to each other when seen from the rotation direction of the refining surface.

7. A refining surface according to claim 1, wherein at least some of the ridge parts are connected to each other, and define an oblique bevel inclined towards the outer edge of the refining surface.

8. A refining surface according to claim 1, wherein the ridge parts define upper surfaces that are in the same plane.

9. A refining surface according to claim 1, further comprising at least one dam structure between ridge parts adjacent in the rotation direction of the refining surface, connecting said ridge parts together.

* * * * *

UNITED STATES PATENT AND TRADEMARK OFFICE

CERTIFICATE OF CORRECTION

PATENT NO. : 7,191,967 B2
APPLICATION NO. : 10/560660
DATED : March 20, 2007
INVENTOR(S) : Vuorio et al.

It is certified that error appears in the above-identified patent and that said Letters Patent is hereby corrected as shown below:

Column 8,
Line 16, after "at" cancel "the".

Signed and Sealed this

Twenty-sixth Day of June, 2007

JON W. DUDAS
*Director of the United States Patent and Trademark Office*